US005724684A

United States Patent [19]

Paar

[11] Patent Number: 5,724,684

[45] Date of Patent: Mar. 10, 1998

[54] RAISED STRAINER

[76] Inventor: Peter Fedorvich Paar, 125 High St., Ashland, Mass. 01721

[21] Appl. No.: 744,638

[22] Filed: Nov. 6, 1996

[51] Int. Cl.[6] ..... E03C 1/26

[52] U.S. Cl. ..... 4/288; 4/286

[58] Field of Search ..... 4/286, 287, 288, 4/290, 291, 292

[56] References Cited

U.S. PATENT DOCUMENTS

| | | | |
|---|---|---|---|
| 1,596,894 | 8/1926 | Schifter | 4/287 |
| 1,935,128 | 5/1933 | Pullman | 4/286 |
| 2,695,411 | 11/1954 | Vinokor | 4/292 |
| 3,788,485 | 1/1974 | Bruning | 210/474 |
| 3,800,339 | 4/1974 | Bergin | 4/286 |
| 4,134,162 | 1/1979 | Sharland et al. | 4/292 |
| 4,447,918 | 5/1984 | Cuschera | 4/286 |
| 4,658,449 | 4/1987 | Martin | 4/496 |

*Primary Examiner*—David J. Walczak
*Attorney, Agent, or Firm*—Joseph H. McGlynn; Patent & Trademark Services, Inc.

[57] ABSTRACT

A drain covering composed of an upper straining region and a lower threaded region. The straining region is in the shape of any conventional drain and has a plurality of straining holes set in various locations on the drain piece. The threaded region is connected to the bottom of the drain, and can be connected to any standard sink. A number of holes are also provided in the strainer to allow a rod to tighten the drain covering into the sink. Waterproof putty is used to seal the connection between the drain covering and the sink.

3 Claims, 1 Drawing Sheet

RAISED STRAINER

BACKGROUND OF THE INVENTION

This invention relates generally to drains and, more generally, to drains with strainers.

DESCRIPTION OF THE PRIOR ART

Numerous inventions relating to drains with strainers have been proposed in the prior art. Often, they seek to drain liquids while preventing certain types of materials and particles from passing through the drain.

U.S. Pat. No. 1,935,128 discloses a removable strainer-trap, or trap device. The device will readily permit the passage or flow of liquid refuse through the waste pipe, but is effective in trapping, collecting, or gathering all hairs and grease contained in the debris or refuse that may be emptied into the waste pipe.

U.S. Pat. No. 4,447,918 discloses a pop-up drain fitting threadedly secured to a spider at the lower end of the drain body with a detent member pivotally joined to the lower end of the pop-up drain fitting. A stop member is disposed adjacent to the detent member to permit the detent member rotation in only one direction. In counterclockwise rotation, a spider member impinges upon the detent arm and pushes it into the stop member, thereby preventing removal of the pop-up member.

U.S. Pat. No. 4,658,449 discloses an adapter for pool drains. The device includes a primary mounting frame secured onto the pool drain with a plurality of arms radiating inwardly and raised to interconnect the second mounting ring. The device also includes a grill work or second secured to the surface of the apparatus for defining a raised screening surface for screening any water flowing into the drain to prevent whirlpooling effect in the drain.

U.S. Pat. No. 3,788,485 discloses a flexible contact lens drain guard having a ring fabricated of rubber or plastic or the like. A mesh net extends across the ring opening and is bonded to or formed unitarily with the ring. Suction means are formed on the base of the ring and extend around its circumference.

Most of the prior art strained drains have aimed only to strain out particular particles, which are generally non-food related. There remains a need for a strained drain which is aimed specifically at a food preparation application and is not easily removed and lost by kitchen help.

SUMMARY OF THE INVENTION

The present invention comprises a drain composed of an upper straining region and a lower threaded region. The straining region is in the shape of any conventional drain and has a plurality of straining holes set in various locations of the drain piece. The threaded region is connected to the bottom of the drain, and can be connected to any standard sink. A number of holes are also provided in the strainer to allow a rod to tighten the invention in the bottom of the sink. Waterproof putty is used to seal the connection between the invention and the sink. All pieces are stainless steel.

Accordingly, it is an object of this invention to provide a drain fixture which is suitable for use in food-preparation environments.

It is a further object of this invention to incorporate straining elements into the drain.

Finally, it is an object of this invention to be easily installed, and be maintained as a permanent strainer and not removed by kitchen help to remove a clogged strainer and hasten the draining process.

DESCRIPTION OF THE PREFERRED EMBODIMENT

Figure 1:
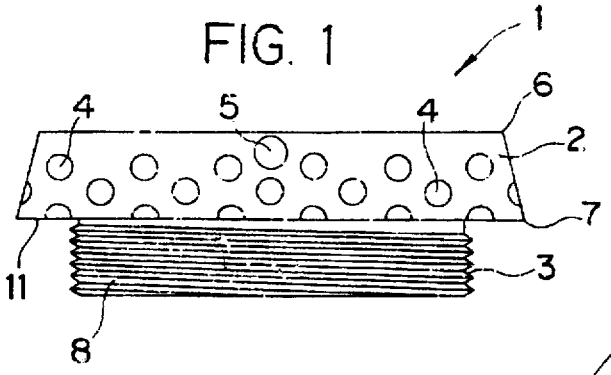
FIG. 1 shows a side view of the present invention.

Referring now to the drawings, there is shown in FIG. 1 the present invention 1 comprising an upper straining piece or rim 2 and a lower threaded piece 3. The straining piece 2 has in it a plurality of circular holes 4 throughout its sides and bottom. Larger holes 5 are also located in the sides of the straining piece 2 for a purpose to be describer below. The threaded piece 3 is cylindrically and provided with standard threads 8.

Figure 2:
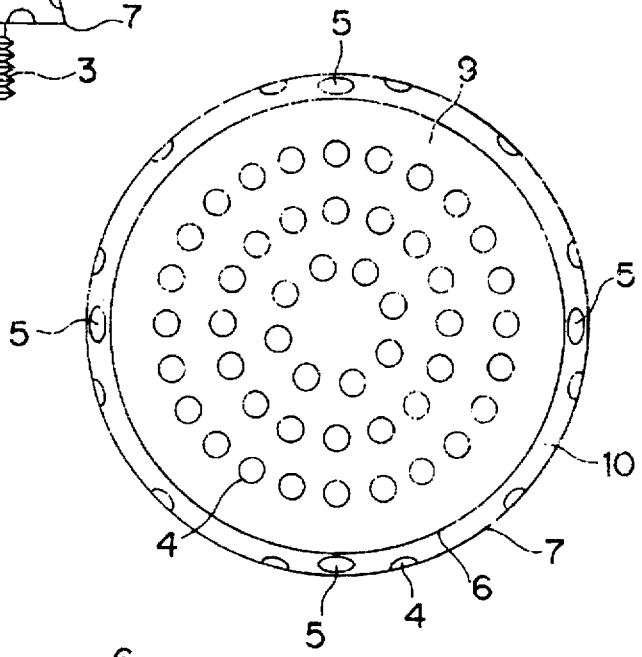
FIG. 2 shows a top view of the present invention.

FIG. 2 shows the drain piece 2, in the shape of a sink drain, that is, in a circular shape, although other shapes could be used. The upper edge 6 of the straining piece 2 is of a smaller diameter than the lower edge 7. The upper part of the drain piece 2 is a hollow ring, while the top surface 9 is a concentric solid circular piece, with numerous straining holes 4. The side 10 of the drain piece 2 is also continuous, and contain straining holes 4 and larger holes 5, and tapers from the upper edge 6 to the lower edge 7. The threaded piece 3 is concentric with the upper edge 6 and the lower edge 7, but is of a substantially smaller diameter than the lower edge 7, so that a small overhang or flange 11 is formed between the lower edge 7 of the strainer 2 and the threaded region 3.

Figure 3:
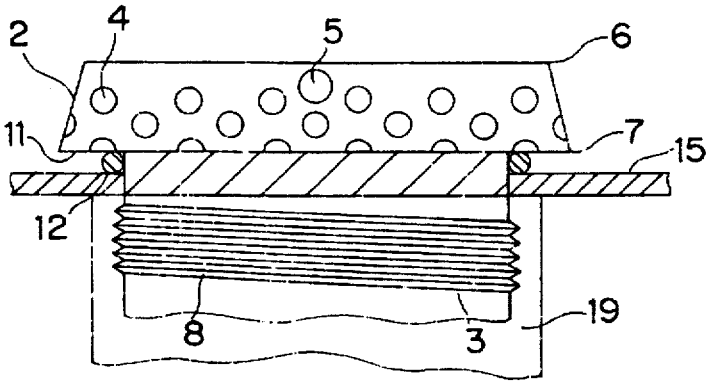
FIG. 3 shows a view of the present invention as it is attached to a sink.
Figure 4:
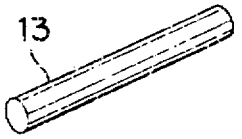
FIG. 4 shows a view of the tool used to install the present invention.
Figure 5:
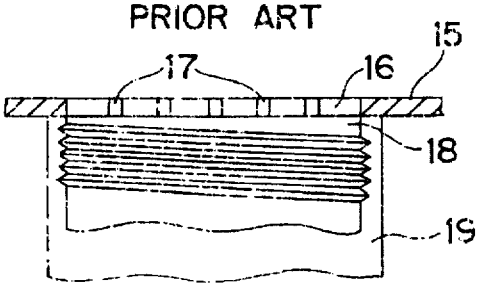
FIG. 5 PRIOR ART
FIG. 5 shows a view of the prior art.

FIG. 3 shows the device as it is secured into a sink 15 which has a circular opening to receive the strainer. The device is placed concentrically within the circular opening, and the threaded piece 3 is placed through the opening so that the flange 11 of the lower edge 7 of the straining piece 2 rests on the sink's top surface 15. A putty (such as plumbers putty) 12 is rolled and placed under the flange 11 as the device is positioned so that the connection between the straining piece 2 and the sink 15 is watertight. A conventional fitting 19 with internal threads is secured to the under side of the sink. This fitting will connect to the drain line beneath the sink so water and small food particles can pass into the sewer line. A rod 13 (shown in FIG. 4) can be inserted into the larger side holes 5 to give leverage to the drain assembly 1 so that it may be threaded tightly into the lever drain assembly 19 thereby creating a water tight joint. In use, the drain assembly 1 acts as any normal strainer, as liquids and small food particles pass through the holes 4 in the straining piece 2 while large foodstuffs and other large particles are stopped by the straining piece 2. The present invention is designed to replace the standard drain strainer 16 shown in FIG. 5. The standard drain is a relatively thin plate with apertures 17 therethrough. It is generally installed so that it is flush with the surface of the sink 15. A threaded fitting 18 is threaded into fitting 19 to make a water tight connection to the drain beneath the sink. One of the major problems with the standard strainer is there are relatively few apertures 17 in it and, therefore, it can be easily clogged. Also, it is made thin so it will fit flush with the surface of the sink. When kitchen helpers, especially in a commercial establishment such as a restaurant, find the strainer clogged with food particles, they have to pry the strainer from the sink to clean it. Sometimes the strainer then becomes misplaced and large food particles can be flushed down the drain, thereby clogging it.

Another problem with the standard strainer is that it must be thin to fit flush with the sink opening. When heavy pots and pans are placed into the sink, they can damage the strainer. Once the strainer is damaged, it will not fit into the sink opening properly, and will no longer strain out large food particles.

The present invention is designed to overcome the problems associated with the standard strainer. By raising the strainer of the present invention above the sink surface, a significantly greater number of apertures 4 can be provided since the apertures can be provided in the sides 2 as well as the bottom 9. This prevents the strainer from being clogged as quickly.

In addition by making the strainer of the present invention with a threaded connection, rather than merely placing the strainer on top of the sink opening as in the prior art, there is less likelihood that the strainer will be misplaced.

Also, by raising the strainer, it can be made using a significantly greater amount of material. This will make the strainer of the present invention stronger and it will not be damaged by heavy pots and pans, thereby increasing the life of the strainer.

All of the assembly pieces described herein are required to be strong enough to allow secure, watertight installation into a sink, as well as rustproof to prevent corrosion of the device. Accordingly, stainless steel is the best option for the device's composition, though any other materials which satisfy these requirements would also be acceptable. The putty 12 used to waterproof the connection between flange 11 and sink 15 can be any conventional putty such as plumber's putty. The threading described herein is to be any normal, conventional threading.

Although the strained drain assembly and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. A strainer for attachment to a sink opening to strain out foreign particles while allowing water to pass through the sink opening, comprising:

a housing having a top, bottom and sides, said top having a perforated surface extending across the entire top, said top being flat, said sides extending between said top and said bottom of said housing, said sides tapering continuously from said top to said bottom so that said bottom is wider than said top, a threaded portion extending from said bottom, said sides having a plurality of apertures therethrough, at least one of said apertures in said sides being larger than the other apertures, means engaging said threaded portion to secure said housing to a sink opening.

2. The strainer as claimed in claim 1, in combination with a sink having a top surface and a bottom surface, and wherein said sink has an opening extending through said surfaces, said threaded portion extending through said sink opening for engaging said means to secure said housing to said sink opening.

3. A strainer for attachment to a sink opening to strain out foreign particles while allowing water to pass through the sink opening in combination with a tool, comprising:

a housing having a top, bottom and sides, said top having a perforated surface extending across the entire top, said sides extending between said top and said bottom of said housing, said sides tapering from said top to said bottom so that said bottom is wider than said top, a threaded portion extending from said bottom, said sides having a plurality of apertures therethrough, at least one of said apertures in said sides being larger than the other apertures, means engaging said threaded portion to secure said housing to a sink opening, and wherein said tool has an outside diameter which is slightly smaller than said larger aperture in said rim, whereby said tool is adapted to be inserted into said larger aperture in order to turn said housing and thereby secure said housing to said sink.

* * * * *